US006598599B2

(12) United States Patent
Takeuchi

(10) Patent No.: US 6,598,599 B2
(45) Date of Patent: Jul. 29, 2003

(54) HOT AIR SPACE HEATER

(75) Inventor: Tomohiko Takeuchi, Chita (JP)

(73) Assignee: Toyotomi Co., Ltd., Nagoya (JP)

( * ) Notice: Subject to any disclaimer, the term of this patent is extended or adjusted under 35 U.S.C. 154(b) by 0 days.

(21) Appl. No.: 10/283,591

(22) Filed: Oct. 30, 2002

(65) Prior Publication Data

US 2003/0079738 A1 May 1, 2003

(30) Foreign Application Priority Data

Oct. 31, 2001 (JP) ..... 2001-334848

(51) Int. Cl.[7] ..... F24H 3/06; F24B 7/00

(52) U.S. Cl. ..... 126/110 D; 126/110 B; 237/55

(58) Field of Search ..... 126/110 D, 110 B, 126/104 A; 237/55

(56) References Cited

U.S. PATENT DOCUMENTS

| | | | | |
|---|---|---|---|---|
| 4,751,910 A | * | 6/1988 | Allen et al. | 126/117 |
| 5,178,124 A | * | 1/1993 | Lu et al. | 126/110 R |
| 5,664,555 A | * | 9/1997 | Maschhoff et al. | 126/110 B |
| 6,295,937 B1 | | 10/2001 | Nakanishi et al. | |
| 6,325,060 B1 | | 12/2001 | Okura et al. | |

FOREIGN PATENT DOCUMENTS

| | | | |
|---|---|---|---|
| EP | 1 217 314 A1 | | 6/2002 |
| JP | 57192740 | * | 11/1982 |
| JP | 58224247 | * | 12/1983 |
| JP | 62142960 | * | 6/1987 |
| JP | 0123950 | * | 5/1989 |
| JP | 05157366 | * | 6/1993 |
| JP | 11-316051 | | 11/1999 |
| JP | 11-316052 | | 11/1999 |
| JP | 2001-004224 | | 1/2001 |

* cited by examiner

*Primary Examiner*—Alfred Basichas
(74) *Attorney, Agent, or Firm*—Pearne & Gordon LLP

(57) ABSTRACT

An object of the present invention is to provide a hot air space heater that is capable of blowing hot air out of a whole wide hot air outlet provided at a front plate of a frame of the heater while making the heater smaller in depth. A burner is arranged so as to be close to one side of the frame. A heat-discharge portion is constructed on the burner. On the other side of the frame, an accessory-receiving space is defined side by side with the heat-discharge portion. Between the hot air outlet provided at the front plate of the frame and a wall portion positioned in front of the accessory-receiving space, an extended air feed space is defined. Air fed by a fan into a duct structure is heated while passing through between a plurality of heat-exchange pipes. The air is blown against a front wall of the duct structure and a plate-like member of an air guide provided on a rear side of louvers. Heated air blown against the front wall flows out forward through a first air flow path above the plate-like member. Heated air blown against the plate-like member is guided into the extended air feed space and flows out forward through the louvers.

10 Claims, 4 Drawing Sheets

HOT AIR SPACE HEATER

BACKGROUND OF THE INVENTION

This invention relates to a hot air space heater that is adapted to blow hot air out of a whole hot air outlet provided at a front plate of a frame of the heater, and more particularly to a hot air space heater of which the frame can be reduced in depth.

A construction of a conventional hot air space heater is shown in FIG. 1 of Japanese Patent Application Laid-open Publication NO. 316052/1999. In this construction, a combustion chamber and a fuel tank are arranged side by side in a frame of the heater, and a hot air outlet extends from a region in front of the combustion chamber toward a front of a region in which the fuel tank is located so that hot or heated air can be blown out of the whole hot air outlet. This conventional hot air space heater employs a special duct structure in order to guide air fed by a fan provided on a rear side of the frame to the hot air outlet. The duct structure has a combustion chamber space including the combustion chamber becoming narrower toward the front, and an extended air feed space spreading laterally from a front region of the combustion chamber space toward a front region of the fuel tank. In addition, a front portion of an upper wall of the duct is inclined toward the hot air outlet. In this conventional duct structure, it is impossible to permit hot air to flow through the extended air feed space without constructing the combustion chamber space narrower toward the front and inclining the front portion of the upper wall of the duct toward the hot air outlet. However, employing these constructions requires a distance between the combustion chamber and the hot air outlet to be relatively long, resulting in an increased depth of the frame of the heater.

In a conventional hot air space heater shown in FIG. 2 of Japanese Patent Application Laid-open Publication No. 316051/1999, the aforementioned extended air feed space is provided and a guide plate is mounted on at least one of louvers arranged in the hot air outlet. This guide plate has a V-shaped cross-section and is fixed onto the louver so as to direct an opening of the guide plate toward the combustion chamber. This duct structure of the heater also requires the front portion of the upper wall of the duct to be inclined toward the hot air outlet. In this hot air space heater, strong air flow without turbulence is blown against the guide plate mounted on the louver in order to guide or turn part of hot air to the extended air feed space. This heater also requires a distance between the combustion chamber and the hot air outlet (or a depth of the frame) to be relatively long because the front portion of the upper wall of the duct must be inclined. Therefore, the depth of the frame can only be reduced to a limited dimension.

Like Japanese Patent Application Laid-open Publication No. 316052/1999, Japanese Patent Application Laid-open Publication No. 4224/2001 (EP 1,217,314 A1) shows a hot air space heater that employs a specially shaped duct structure in order to permit hot air to flow into an extended air feed space.

FIG. 1 of U.S. Pat. No. 6,295,937 shows an example of a conventional hot air space heater in which a heat exchanger is arranged above a combustion chamber. In this example, the heater heats air taken into a duct structure from an indoor air intake port provided on a rear side of a frame of the heater by making the air contact with an outer wall of the combustion chamber and the heat exchanger, and then blows the heated air out of a hot air outlet. In this heater, the hot air outlet is arranged lower than the indoor air intake port.

U.S. Pat. No. 6,325,060 discloses a hot air space heater which is so constructed that a plurality of heat-exchange pipes are arranged on a combustion chamber and that a heat-exchange chamber is arranged on these heat-exchange pipes.

SUMMARY OF THE INVENTION

A hot air space heater of the present invention comprises a frame having a front plate, a rear plate, a pair of side plates connecting said front and rear plates, and a top plate. An indoor air intake port is provided at the rear plate. A hot air outlet is provided at the front plate. The hot air outlet is formed so as to extend from a position in proximity to one of the side plates to a position in proximity to the other side plate in a lateral direction, and is positioned lower than the indoor air intake port. The heater also comprises a burner arranged in the frame in a manner to be close to one of the side plates rather than at a central portion of the frame, a combustion chamber arranged on and communicating with the burner, a heat exchanger arranged on an upper plate of the combustion chamber and communicating with the combustion chamber, and a duct structure having an air feed passage therein. The heater further comprises an indoor air convection fan arranged in the vicinity of the indoor air intake port to take in indoor air into the air feed passage.

The heat exchanger, for example, includes a plurality of heat-exchange pipes extending upward from the upper plate of the combustion chamber and an exhaust gas chamber arranged on and communicating with these heat-exchange pipes.

The hot air outlet has a first hot air outlet portion positioned in front of the upper portion of the combustion chamber and the heat exchanger, and a second hot air outlet portion laterally contiguous to the first hot air outlet portion and positioned in front of a region including an accessory-receiving space.

The duct structure includes a first side wall arranged adjacent to the one side plate; a second side wall facing the first side wall in the lateral direction so as to have the upper portion of the combustion chamber, a plurality of the heat-exchange pipes, and the exhaust gas chamber positioned therebetween and also facing the other side plate of the frame in the lateral direction so as to form the accessory-receiving space therebetween; a bottom wall positioned lower than the upper portion of the combustion chamber; a top wall having a main portion thereof positioned upper than the heat exchanger; and a front wall positioned between a front end of the top wall and the hot air outlet and longitudinally extending along the front plate. The second side wall includes a first side wall portion positioned on a side of the rear plate and extending along or juxtaposedly with the first side wall and a second side wall portion connecting to the first side wall portion and extending in the lateral direction so as to form an extended air feed space laterally spreading between the second side wall portion and the second hot air outlet portion.

In the present invention, an air guide is arranged in the duct structure. The air guide is arranged along the first outlet portion of the hot air outlet facing the upper portion of the combustion chamber so as to guide or turn part of air to be blown forward out of the first hot air outlet portion to the extended air feed space. Providing such air guide in the duct structure can guide or turn part of the air directed forward through the second hot air outlet portion to the extended air feed space, even when a distance from the upper portion of the combustion chamber and the heat exchanger to the hot air outlet is reduced. In other words, hot air blown against the air guide is reflected backward and then tends to flow toward the extended air feed space having a smaller air resistance. The air guide positively guides or turns the air flow to the extended air feed space. Thus, in accordance with the present invention, a sufficient amount of hot air can also be blown forward out of the second outlet portion of the hot air outlet corresponding to the extended air feed space.

A vertical dimension or height of the hot air outlet is preferably defined so as to be able to face both the upper portion of the combustion chamber and lower portions of a plurality of the heat-exchange pipes communicating with the combustion chamber. This enables sufficient heat exchange at the heat exchanger.

The air guide is preferably formed so as to have a plate-like member extending toward the extended air feed space along the first hot air outlet portion. Any support structure may be selected for the plate-like member. The plate-like member may be supported by the first or second side wall or the bottom wall of the duct structure. In these cases, the plate-like member is arranged in a manner to define a first air flow path between an upper edge of the plate-like member and the front wall of the duct structure and a second air flow path between a lower edge of the plate-like member and the bottom wall of the duct structure. This arrangement enables both hot air flowing downward along the front wall and hot air flowing directly to the hot air outlet through between a plurality of the heat-exchange pipes to blow out of the first air flow path. Hot air flowing around the upper portion of the combustion chamber and directly into the second air flow path, and most of hot air flowing around the heat-exchange pipes and blown against the plate-like member get together and flow out of the second air flow path. An interval size (distance) between the lower edge of the plate-like member and the bottom wall is defined so as to permit hot air passing through the second air flow path to flow out forward. Specifically, the lower edge of the plate-like member is arranged in proximity to the upper plate of the combustion chamber. In a case where at least part of the hot air flowing out of the first air flow path goes downward, this flow will be re-directed or turned forward rather than downward by means of the hot air flowing forward out of the second air flow path. As a result, hot air can reach a user of the heater sitting in front of the heater.

It is preferable to arrange the plate-like member so that one end thereof is fixed onto the first side wall of the duct structure and the other end is positioned on a side of the extended air feed space. In this arrangement, an air flow path is not formed between the first side wall and the plate-like member, thereby guiding most of hot air blown against the plate-like member to the extended air feed space along the plate-like member. Also, since no support structure exists in the second air flow path, the rate of hot air flowing out of the second air flow path will not be decelerated.

The second side wall portion of the second side wall may extend substantially in parallel to the hot air outlet. This can simplify a shape of the second side wall of the duct structure.

The first side wall and the first side wall portion of the second side wall of the duct structure may be provided each with an air-blocking plate that prevents air fed by the fan from flowing directly into the second air flow path by reducing a gap formed between an outer circumferential surface of the upper portion of the combustion chamber and an inner surface of the first side wall, and a gap formed between the outer circumferential surface of the upper portion of the combustion chamber and an inner surface of the first side wall portion of the second side wall (theoretically, the gap size may be reduced to zero). As these gaps become larger, air from the fan will be fed through the gaps straight into the second air flow path. With this situation being kept, it will result in an extremely increased amount of hot air flowing out of the second air flow path, thereby reducing an amount of hot air flowing into the extended air feed space. However, providing an air-blocking plate substantially eliminates such air flowing from the fan directly into the second air flow path, which in turn prevents hot air flowing out of the second air flow path from increasing extremely. As a result, a sufficient amount of hot air can positively flow into the extended air feed space. When thus-formed gaps are very small, it is not necessary to provide an air-blocking plate.

In the duct structure, a boundary portion between the first and second side wall portions of the second side wall is preferably positioned on a front side of the air blocking plate and on a rear side of an front edge portion of the upper portion of the combustion chamber. This positioning widens an opening of a space positioned on a rear side of the air guide and communicating with the extended air feed space. Accordingly, air resistance against the extended air feed space becomes smaller than that against the second air flow path, thereby permitting a larger amount of hot air to flow into the extended air feed space, accelerating the hot air flowing forward out of the second outlet portion, and enabling the hot air to reach further than ever.

BRIEF DESCRIPTION OF THE DRAWINGS

These and other objects and further features of the present invention will be apparent from the following detailed description when read in conjunction with the accompanying drawings, wherein.

DETAILED DESCRIPTION OF THE PREFERRED EMBODIMENT

Figure 1:
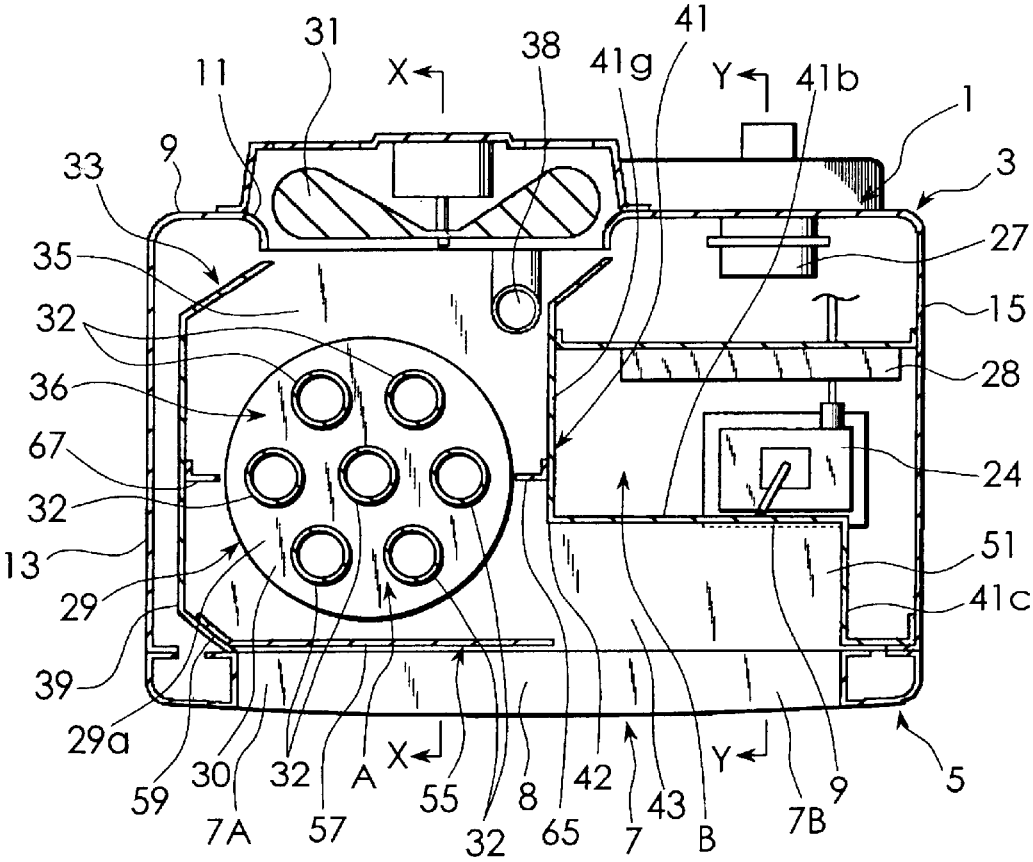
FIG. 1 is a cross-sectional view showing an embodiment of a hot air space heater according to the present invention.
Figure 2:
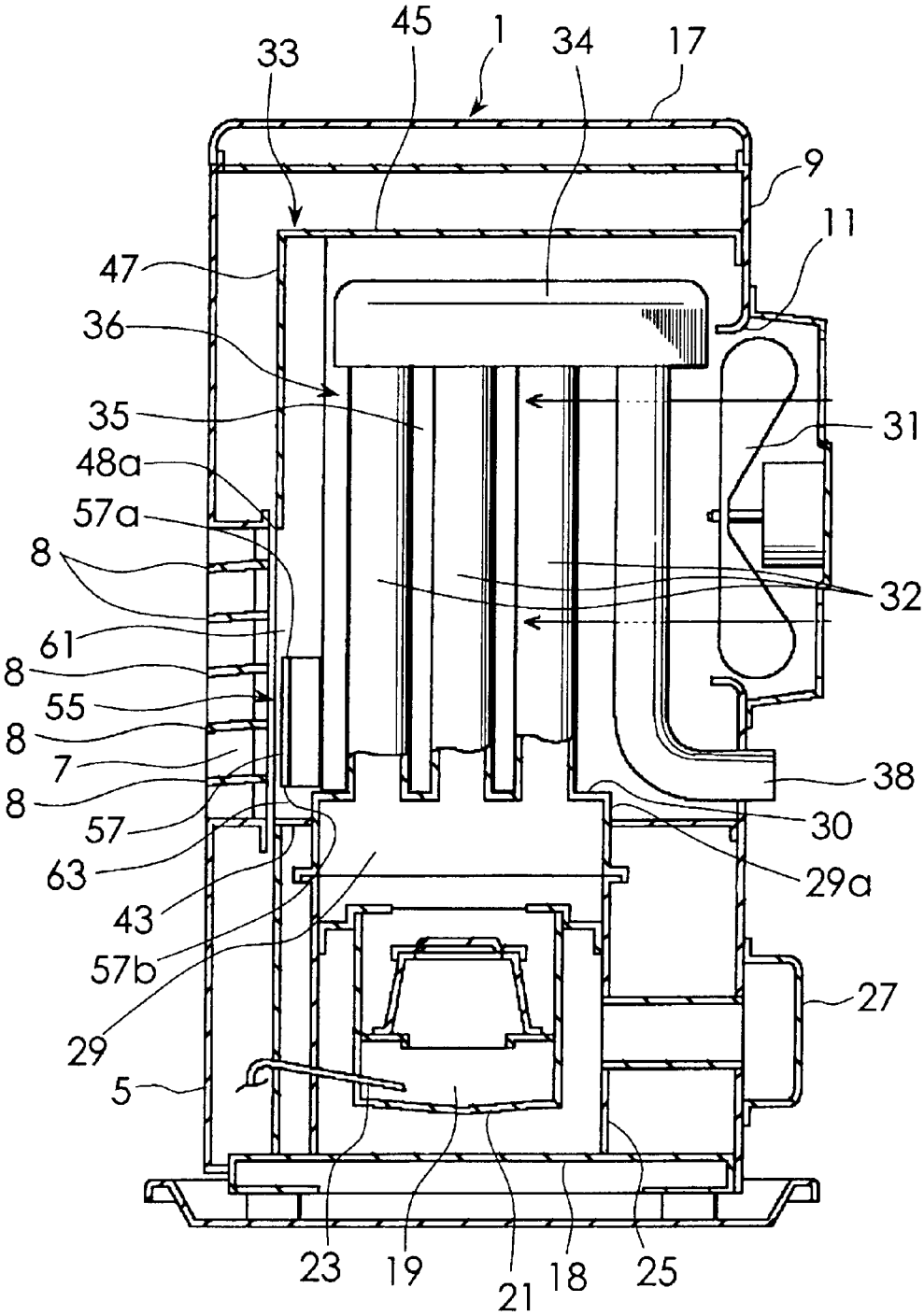
FIG. 2 is an X—X vertical sectional view of the heater shown in FIG. 1.

Now, a hot air space heater of the present invention will be described with reference to the accompanying drawings. Referring first to FIGS. 1 and 2, an embodiment of a hot air space heater according to the present invention is illustrated, which is applied to an oil-fired space heater or a so-called oil-fired fan heater using kerosene as fuel therefor. A hot air space heater of the illustrated embodiment which is generally designated at reference numeral 1 includes a frame 3 made of metal. The frame 3 includes a front plate 5 formed with a hot air outlet 7, and a rear plate 9 formed with an indoor air intake port 11. The frame 3 further includes a pair of side plates 13, 15 connecting the front plate 5 and the rear plate 9, a top plate 17, and a bottom plate 18. In the frame 3, a burner 19 is arranged so as to be close to one side plate 13 of the frame 3 rather than at a central portion of the frame 3. The hot air outlet 7 includes a first hot air outlet portion 7A and a second hot air outlet portion 7B that are arranged so as to be contiguous to each other in a lateral direction relative to the frame. The first outlet portion 7A faces a heat-discharge portion A in which an upper portion 29*a* of a combustion chamber 29 and part of a heat exchanger 36 are positioned. The second outlet portion 7B is positioned in front of an accessory-receiving space, namely a controlling mechanism portion formed in proximity to the other side plate 15 beyond the heat-discharge portion A. Five louvers 8 are provided in the hot air outlet 7 in a manner to be longitudinally spaced from each other and so as to orientate hot air downward.

The burner 19, in the illustrated embodiment, is a so-called pot-type burner. The burner 19 includes a pot 21 having a plurality of through-holes or air holes formed on an circumferential surface thereof, a ceramic heater (not shown) arranged in the pot 21 for preheating and ignition, a cylindrical member 25 arranged around the pot 21 so as to define an air channel therebetween for guiding combustion air therethrough to the pot, and a combustion air feed fan 27 arranged below the cylindrical member 25 for feeding indoor air acting as combustion air into the cylindrical member 25. The pot 21 is provided therein with a fuel nozzle 23 through which kerosene fuel is fed from a fuel tank (not shown) to the pot 21. A fuel pump 24 acting as a fuel supply means is used to feed fuel from the fuel tank to the fuel nozzle 23. The fuel pump 24 is arranged on a means for preventing fluctuations in oil level.

The combustion chamber 29 formed with a cylinder is mounted on the burner 19 so as to communicate therewith, thereby being fed with combustion flame and combustion gas from the burner 19. A structure of such a pot-type burner and operation thereof are widely known in the art and will not be described herein.

An upper plate 30 of the combustion chamber 29 is provided thereon with a heat exchanger 36 that includes seven heat-exchange pipes 32 communicating with the combustion chamber 29 and an exhaust gas chamber 34 arranged on and communicating with these seven heat-exchange pipes 32. An exhaust gas pipe 38 is provided so as to connect to the exhaust gas chamber 34 for discharging exhaust gas out to open air outside a room.

The frame 3 also has an indoor air convection fan 31 (hereafter referred to as a convection fan) constituted by an axial flow fan and arranged in proximity to the indoor air intake port 11. The convection fan 31 includes a motor, which is fixed at the frame 3 by means of a mount plate. The frame 3 is provided therein with a duct structure 33 having an air feed passage 35 that receives the upper portion 29*a* of the combustion chamber 29, the seven heat-exchange pipes 32, and the exhaust gas chamber 34. The convection fan 31 functions to feed indoor air from the indoor air intake port into the air feed passage 35. Then, the indoor air thus taken in is heated by means of heat discharged from the combustion chamber 29, the heat-exchange pipes 32, and the exhaust gas chamber 34. The convention fan 31 generates wind for guiding thus-heated indoor air toward the hot air outlet 7. The duct structure 33 is arranged so as to form between the duct structure and the other side plate 15 an accessory-receiving space B for receiving a plurality of accessories (including the fuel pump 24, the fan 27, and a controller 28) used to conduct and control combustion at the burner 19.

Figure 3:
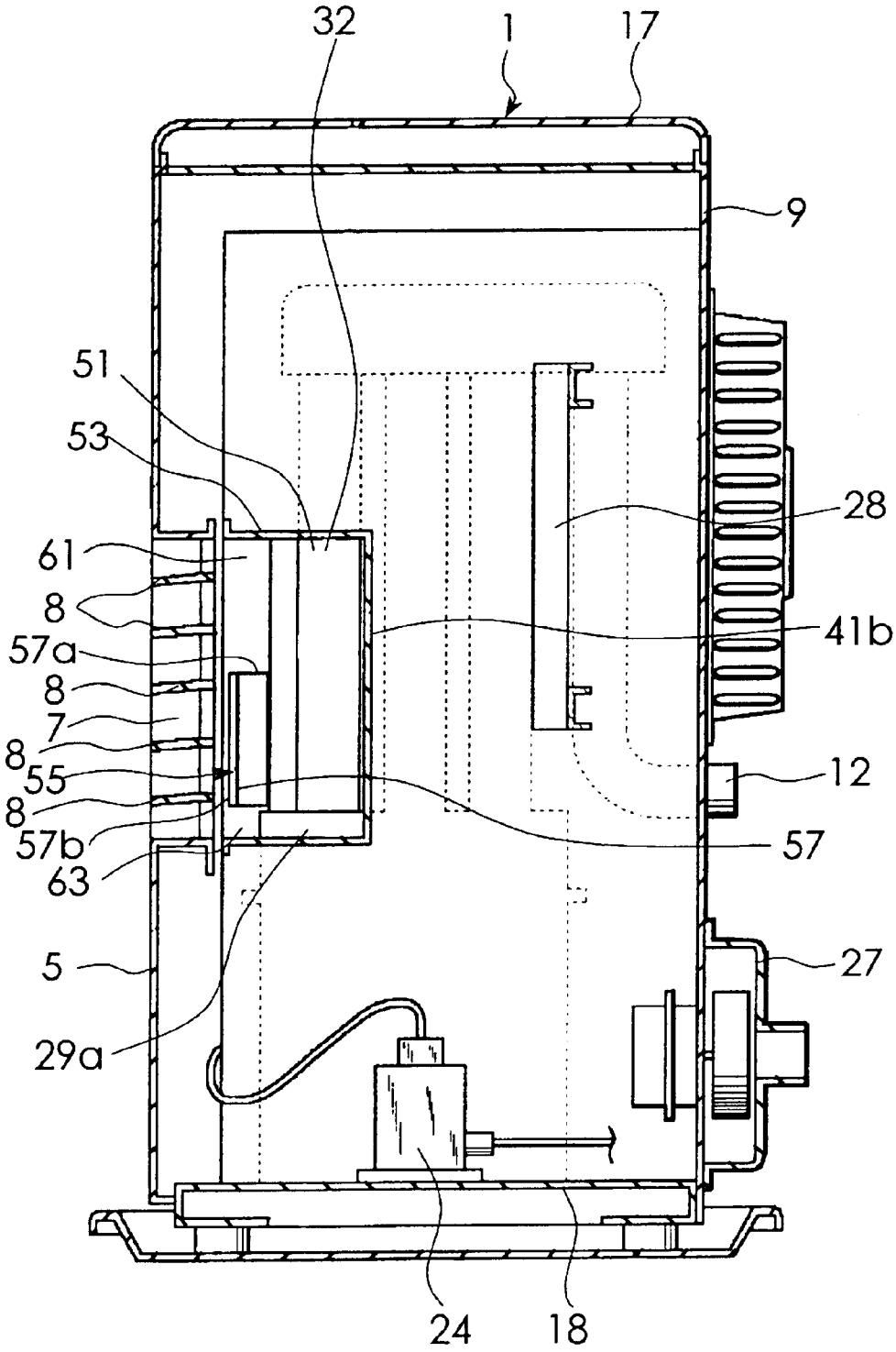
FIG. 3 is a Y—Y vertical sectional view of the heater shown in FIG. 1.
Figure 4:
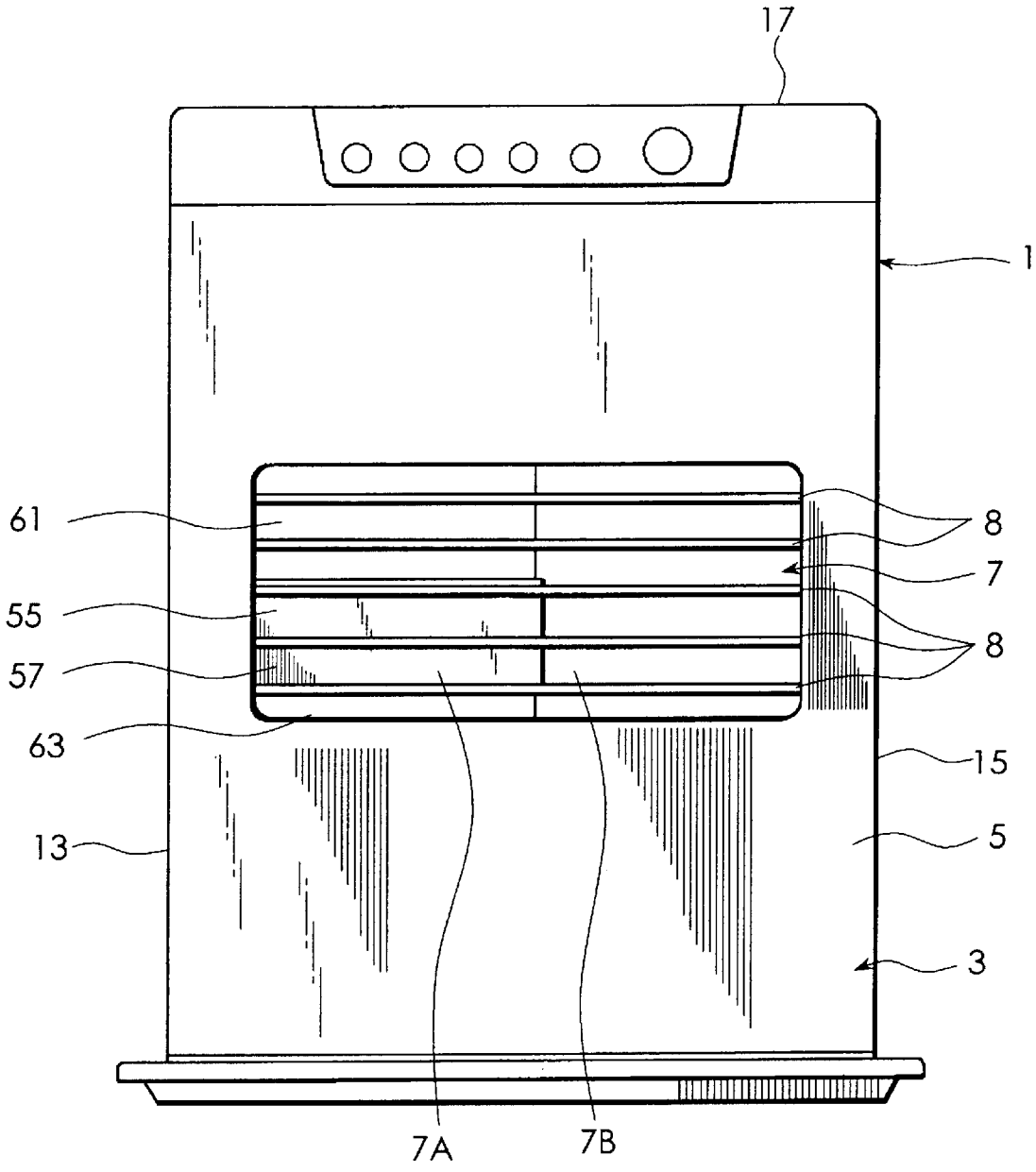
FIG. 4 is a front view of the heater shown in FIG. 1.

The duct structure 33 includes a first side wall 39, a second side wall 41, a bottom wall 43, a top wall 45, and a front wall 47. The first wall 39 is arranged adjacent to the side plate 13 of the frame 3. As shown in FIG. 1, a rear portion of the first side wall 39 is bent like a crank. The second side wall 41 faces the first side wall 39 through the air feed passage 35 in the lateral direction so as to have the upper portion 29*a* of the combustion chamber 29, the seven heat-exchange pipes 32, and the exhaust gas chamber 34 positioned between the first and second walls. The second side wall 41 also faces the other side plate 15 in the lateral direction so as to form the accessory-receiving space B therebetween. The second side wall 41 includes a first side wall portion 41*a* positioned on a side of the rear plate 9 and extending in a depth direction in parallel to the first side wall 39, a second side wall portion 41*b* connecting to the first side wall portion 41*a* and extending in the lateral direction, and a third side wall portion 41*c* connecting to the second side wall portion 41*b* and extending in the depth direction. In this embodiment, the first side wall portion 41*a* extends until above an entrance of the extended air feed space 51 so as to have an extended wall portion that limits a height of the extended air feed space 51. As shown in FIG. 3, the duct structure is provided therein with a top wall portion 53 arranged on a position corresponding to the extended air feed space 51 and extending horizontally on a level lower than the top wall 45 for the purpose of limiting the height of the extended air feed space 51. A cross-sectional area of the extended air feed space 51 is smaller than that of the air feed passage 35 in which the heat exchanger 36 is positioned. The first side wall portion 41*a* and the second side wall portion 41*b* form an angle of approximately 90 degrees. The second side wall portion 41*b* extends in parallel to a second outlet portion 7B of the hot air outlet 7. The second side wall portion 41*b* and the third side wall portion 41*c* form the extended air feed space 51 laterally spreading between these two side wall portions 41*b*, 41*c* and the second outlet portion 7B of the hot air outlet 7. The bottom wall 43 is positioned lower than the upper portion 29*a* of the combustion chamber 29. The top wall 45 has its main portion positioned upper than the exhaust gas chamber 34. The front wall 47 is positioned between a front end of the top wall 45 and the hot air outlet 7 and longitudinally extending along the front plate 5.

The duct structure 33 is provided therein with an air guide 55. The air guide 55 is arranged along the first outlet portion 7A of the hot air outlet 7 facing the upper portion 29*a* of the combustion chamber 29 so as to guide or turn part of air to be blown forward out of the first hot air outlet portion 7A to the extended air feed space 51. The air guide used in this embodiment has a plate-like member 57 extending toward the extended air feed space 51 along the first hot air outlet portion 7A. Any support structure may be selected for the plate-like member 57. In this embodiment, a mount portion 59 formed by subjecting one end of the plate-like member to bending is fixed onto an inner surface of the first side wall 39 of the duct structure 33 by means of welding.

As shown in FIG. 2, the plate-like member 57 is arranged in a manner to define a first air flow path 61 between an upper edge 57*a* of the plate-like member 57 and a lower edge 47*a* of the front wall 47 and a second air flow path 63 between a lower edge 57*b* of the plate-like member 57 and the bottom wall 43 of the duct structure 33. This arrangement enables both heated air flowing downward along the front wall 47 and heated air flowing directly to the hot air outlet 7 through between the seven heat-exchange pipes 32 to flow out of the first air flow path 61. From the second air flow path 63, heated air flowing around the upper portion 29*a* of the combustion chamber 29 and directly into the second air flow path 63 and most of heated air flowing around the seven heat-exchange pipes 32 and blown against the plate-like member 57 flow out together. An interval size (distance) between the lower edge 57*b* of the plate-like member 57 and the bottom wall 43 is defined so as to permit the heated air passing through the second air flow path 63 to flow forward. Specifically, the lower edge 57*b* of the plate-like member 57 is arranged in proximity to the upper portion 29*a* of the combustion chamber 29. In a case where at least part of the hot air flowing out of the first air flow path 61 goes downward, this flow will be re-directed forward rather than downward by means of the hot air flowing forward out of the second air flow path 63. Thus, hot air can reach a user of the heater sitting away from the front of the heater.

As shown in FIG. 1, the first side wall 39 and the first side wall portion 41*a* of the second side wall 41 of the duct structure 33 are provided respectively with air-blocking plates 65, 67 that prevent air fed by the convection fan 31 from flowing directly into the second air flow path 63 by reducing a gap formed between an outer circumferential surface of the upper portion 29*a* of the combustion chamber 29 and an inner surface of the first side wall 39, and a gap formed between the outer circumferential surface of the upper portion 29*a* of the combustion chamber 29 and an inner surface of the first side wall portion 41*a* of the second side wall 41 (theoretically, the gap size may be reduced to zero). As these gaps become larger, air from the convection fan 31 tends to be fed therethrough straight into the second air flow path 63. With this situation being kept, it will result in an extremely increased amount of hot air flowing out of the second air flow path 63, thereby reducing an amount of the hot air flowing into the extended air feed space 51. However, providing the air-blocking plates 65, 67 substantially eliminates such air flowing from the convection fan 31 directly into the second air flow path 63, which in turn prevents hot air flowing out of the second air flow path 63 from increasing extremely. As a result, a sufficient amount of hot air can positively flow into the extended air feed space 51.

In the duct structure, a boundary portion 42 between the first and second side wall portions 41*a*, 41*b* of the second side wall 41 is positioned on a front side of the air blocking plate 65 and on a rear side of an front edge of the upper portion 29*a* of the combustion chamber 29. This positioning widens an opening of a space positioned on a rear side of the air guide 55 and communicating with the extended air feed space 51. Accordingly, air resistance against the extended air feed space 51 becomes smaller than that against the second air flow path 63, thereby permitting a larger amount of hot air to flow into the extended air feed space 51. In addition, the forward flow of hot air from the second outlet portion 7B is accelerated and enabled to reach further than ever.

In this embodiment, high-temperature combustion gas generated by the burner 19 is collected into the exhaust gas chamber through the combustion chamber 29 and the heat-exchange pipes 32, and then is discharged out of the exhaust gas pipe 38. Indoor air fed into the duct structure 33 by the convention fan 31 is heated to become hot air by means of the highly heated upper portion 29*a* of the combustion chamber 29, the heat-exchange pipes 32, and the exhaust gas chamber 34. Then, the heated air is blown out of the hot air outlet 7. Most of hot air heated primarily by the heat exchanger 36 is blown out toward the front wall 47 and hot air outlet 7 without being hindered by the combustion chamber 29. Then, hot air is blown out forward from the first and second air flow paths 61, 63 positioned respectively above and below the plate-like member 57 of the air guide 55. Hot air blown against the front wall 47 then flows downward to the hot air outlet 7, and goes out forward through the first air flow path 61. Hot air passing through between the heat-exchange pipes and flowing toward the plate-like member 57 of the air guide 55 positioned on a rear side of the hot air outlet 7 does not easily flow into the first air flow path 61. This is because the hot air blown against the front wall 47 also flows through the first air flow path 61. Thus, hot air tends to flow downward and then forward through the second air flow path 63. However, the second air flow path 63 is narrow since the lower edge 57*b* of the plate-like member 57 is positioned in proximity to the upper portion 29*a* of the combustion chamber 29, and the combustion chamber 29 is close to the louvers 8 mounted in the hot air outlet 7. Although wind generated by the fan 31 tends to go directly to the second air flow path 63 below the plate-like member 57, it is hindered by the upper portion 29*a* of the combustion chamber 29. Thus, a strong flow of hot air cannot pass through the second air flow path 63. Consequently, most of the hot air blown against the plate-like member 57 tends to be directed or turned to the side of the plate-like member 57 (toward the extended air feed space 51). Thus, the hot air blown against the plate-like member 57 is turned to the extended air feed space 51, and is finally blown out of the second hot air outlet portion 7B as it is out of the first hot air outlet portion 7A.

Hot air blown against the front wall 47 and blown out of the first air flow path 61 strongly tends to flow along a front surface of the plate-like member 57 and downward to the floor. Even though a strong flow of hot air cannot pass through the second air flow path 63 below the plate-like member 57, part of hot air is blown out therethrough. Hot air flowing downward along the front surface of the plate-like member 57 is turned away therefrom by a small amount of hot air blown out of the second air flow path 63 positioned below. As a result, hot air blown out of the first air flow path 61 flows forward.

The air-blocking plates 65, 67 work effectively when a size (or diameter) of the upper portion 29*a* of the combustion chamber 29 is smaller than a width of the air feed passage 35. In other words, not only the combustion chamber 29 but also the air-blocking plates 65, 67 hinder the wind flowing from the fan 31 toward the second air flow path 63 below the plate-like member 57. Thus, a flow of hot air blown against the upper portion 29*a* of the combustion chamber 29 and then spread apart and another flow of hot air directing toward between the upper portion 29*a* and the first and second side walls 39, 41 are both prevented from flowing toward the second air flow path 63. This enables most of the hot air blocked by the plate-like member 57 of the air guide 55 to be guided toward the extended air feed space 51 and blown positively out of the second outlet portion 7B.

According to this embodiment of the present invention, the aforementioned construction can blow hot air out of the second outlet portion 7B of the hot air outlet 7 positioned in front of the accessory-receiving space B while reducing the dimension in a thickness direction (or depth) of the hot air space heater.

Particularly, in the present invention, hot air flow can be guided or turned merely by providing the air guide 55 for guiding or turning hot air to the extended air feed space 51, thereby enabling the depth of the frame 3 to be smaller than ever and accordingly the heater to be compact in both width and depth.

Further, the present invention is not limited to this embodiment, but various variations and modifications may be made without departing from the scope of the present invention.

What is claimed is:

1. A hot air space heater comprising:

a frame having a front plate, a rear plate, a pair of side plates connecting said front and rear plates, and a top plate;

an indoor air intake port provided at said rear plate;

a hot air outlet provided at said front plate:

said hot air outlet being formed so as to extend from a position in proximity to one of said side plates to a position in proximity to the other side plate in a lateral direction, and positioned lower than said indoor air intake port;

a burner arranged in said frame in a manner to be close to said one side plate rather than at a central portion of said frame;

a combustion chamber arranged on and communicating with said burner;

a heat exchanger arranged on an upper plate of said combustion chamber and communicating with said combustion chamber;

a duct structure arranged in said frame and having an upper portion of said combustion chamber and said heat exchanger incorporated therein in a manner to define an air feed passage between said air indoor air intake port and said hot air outlet;

an accessory-receiving space formed between said duct structure and said other side plate of said frame for receiving a plurality of accessories used to conduct and control combustion at said burner; and an indoor air convection fan arranged in the vicinity of said indoor air intake port to feed indoor air therethrough into said air feed passage, wherein said hot air outlet has a first hot air outlet portion positioned in front of said upper portion of said combustion chamber and said heat exchanger, and a second hot air outlet portion laterally contiguous to said first hot air outlet portion and positioned in front of a region including said accessory-receiving space;

wherein said duct structure includes:

a first side wall arranged adjacent to said one side plate;

a second side wall facing said first side wall in said lateral direction so as to have said upper portion of said combustion chamber and said heat exchanger positioned therebetween and also facing said other side plate of said frame in said lateral direction so as to form said accessory-receiving space therebetween;

said second side wall having a first side wall portion positioned on a side of said rear plate and extending along said first side wall and a second side wall portion connecting to said first side wall portion and extending in said lateral direction so as to form an extended air feed space laterally spreading along said second hot air outlet portion;

a bottom wall positioned lower than said upper portion of said combustion chamber;

a top wall having a main portion thereof positioned upper than said heat exchanger; and a front wall positioned between a front end of said top wall and said hot air outlet and longitudinally extending along said front plate; and wherein said duct structure is provided therein with an air guide arranged along said first outlet portion of said hot air outlet and so as to guide part of air to be blown forward out of said first hot air outlet portion to said extended air feed space.

2. The hot air space heater of claim 1, wherein said heat exchanger is arranged on said upper plate of said combustion chamber and comprises a plurality of heat-exchange pipes communicating with said combustion chamber and extending upward from said upper plate of said combustion chamber and an exhaust gas chamber arranged on and communicating with said plurality of heat-exchange pipes; and wherein a vertical dimension of said hot air outlet is defined so as to be able to face both of said upper portion of said combustion chamber and lower side portions of said plurality of heat-exchange pipes.

3. The hot air space heater of claim 1, wherein said air guide has a plate-like member extending toward said extended air feed space along said first outlet portion and is arranged so as to define a first air flow path between an upper edge of said plate-like member and said front wall and a second air flow path between a lower edge of said plate-like member and said bottom wall, and a distance between said lower edge of said plate-like member and said bottom wall is defined so as to permit hot air to flow forward out of said second air flow path.

4. The hot air space heater of claim 3, wherein said lower edge of said plate-like member is arranged in proximity to said upper plate of said combustion chamber.

5. The hot air space heater of claim 4, wherein one end of said plate-like member is fixed to said first side wall and the other end is positioned on a side of said extended air feed space.

6. The hot air space heater of claim 1, wherein said second side wall portion extends substantially in parallel to said hot air outlet.

7. The hot air space heater of claim 1 or 2, wherein said first side wall and said first side wall portion of said second side wall are provided each with an air-blocking plate that prevents wind generated by said air convection fan from directly flowing into said second air flow path by reducing a gap formed between an outer circumferential surface of said upper portion of said combustion chamber and an inner surface of said first side wall, and a gap formed between said circumferential surface of said upper portion of said combustion and an inner surface of said first side wall portion of said second side wall.

8. The hot air space heater of claim 7, wherein a boundary portion between said first and second side wall portions of said second side wall is positioned on a front side of said air blocking plate and on a rear side of an front edge portion of said upper portion of said combustion chamber.

9. A hot air space heater comprising:

a frame having a front plate, a rear plate, a pair of side plates connecting said front and rear plates, and a top plate;

an indoor air intake port provided at said rear plate;

a hot air outlet provided at said front plate:

said hot air outlet being formed so as to extend from a position in proximity to one of said side plates to a position in proximity to the other side plate in a lateral direction, and positioned lower than said indoor air intake port;

a plurality of louvers arranged in said hot air outlet and longitudinally spaced from each other;

a burner arranged in said frame in a manner to be close to said one side plate rather than at a central portion of said frame;

a combustion chamber arranged on and communicating with said burner;

a plurality of heat-exchange pipes arranged on an upper plate of said combustion chamber, and communicating with said combustion chamber and extending upward from said upper plate of said combustion chamber;

an exhaust gas chamber arranged on and communicating with said plurality of heat-exchange pipes;

an exhaust gas pipe arranged so as to connect to said exhaust gas chamber for discharging exhaust gas out;

a duct structure arranged in said frame and having said upper portion of said combustion chamber, said plurality of heat-exchange pipes, and said exhaust gas chamber incorporated therein in a manner to define an air feed passage between said indoor air intake port and said hot air outlet;

an accessory-receiving space formed between said duct structure and said other side plate of said frame for receiving a plurality of accessories including a fuel supply means and a controller used to conduct and control combustion at said burner; and an indoor air convection fan arranged in the vicinity of said indoor air intake port to feed indoor air therethrough into said air feed passage, wherein said hot air outlet has a first hot air outlet portion positioned in front of said upper portion of said combustion chamber and said plurality of heat exchange pipes, and a second hot air outlet portion laterally contiguous to said first hot air outlet portion and positioned in front of a region including said accessory-receiving space;

wherein said duct structure includes:

a first side wall arranged adjacent to said one side plate;

a second side wall facing said first side wall in said lateral direction so as to have said upper portion of said combustion chamber, said plurality of heat-exchange pipes, and said exhaust gas chamber positioned therebetween and also facing said other side plate of said frame in said lateral direction so as to form said accessory-receiving space therebetween;

said second side wall having a first side wall portion positioned on a side of said rear plate and extending along said first side wall and a second side wall portion connecting to said first side wall portion and extending in said lateral direction so as to form an extended air feed space laterally spreading along said second hot air outlet portion;

a bottom wall positioned lower than said upper portion of said combustion chamber;

a top wall having a main portion thereof positioned upper than said exhaust gas chamber; and a front wall positioned between a front end of said top wall and said hot air outlet and longitudinally extending along said front plate;

wherein said duct structure is provided therein with an air guide arranged along said first outlet portion of said hot air outlet facing said upper portion of said combustion chamber and so as to guide part of air to be blown forward out of said first hot air outlet portion to said extended air feed space; and wherein said air guide has a plate-like member extending toward said extended air feed space along said first outlet portion, and said plate-like member is arranged so as to define a first air flow path between an upper edge of said plate-like member and said front wall and a second air flow path between a lower edge of said plate-like member and said bottom wall.

10. The hot air space heater of claim 9, wherein a vertical dimension of said extended air feed space is defined so as to make said extended air feed space substantially face said second outlet portion of said hot air outlet.

* * * * *

UNITED STATES PATENT AND TRADEMARK OFFICE

CERTIFICATE OF CORRECTION

PATENT NO. : 6,598,599 B2
DATED : July 29, 2003
INVENTOR(S) : Takeuchi

It is certified that error appears in the above-identified patent and that said Letters Patent is hereby corrected as shown below:

Column 9,
Line 25, please delete the second occurrence of "air".
Line 59, please delete "upper", and insert therefor -- higher --.

Column 10,
Line 46, please delete "an", and insert therefor -- a --.

Signed and Sealed this

Thirtieth Day of September, 2003

JAMES E. ROGAN
*Director of the United States Patent and Trademark Office*